US008505514B2

(12) United States Patent
Fang et al.

(10) Patent No.: US 8,505,514 B2
(45) Date of Patent: Aug. 13, 2013

(54) FLUID INJECTOR WITH AUXILIARY FILLING ORIFICE

(75) Inventors: Dianqi Fang, Dunlap, IL (US); Lin Zhang, Dunlap, IL (US); Stephen Robert Lewis, Chillicothe, IL (US); Zhenlong Xu, Peoria, IL (US); Avinash R. Manubolu, Edwards, IL (US); Shriprasad G. Lakhapati, Glendale Heights, IL (US); Christopher D. Hanson, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 635 days.

(21) Appl. No.: 12/720,455

(22) Filed: Mar. 9, 2010

(65) Prior Publication Data

US 2011/0220064 A1 Sep. 15, 2011

(51) Int. Cl.
*F02M 69/04* (2006.01)
*F02M 43/00* (2006.01)

(52) U.S. Cl.
USPC ..... 123/445; 123/478; 239/533.3

(58) Field of Classification Search
USPC ..... 123/445–447, 456, 472, 478, 490, 123/501, 502; 239/533.2, 533.3, 584, 585.5
See application file for complete search history.

(56) References Cited

U.S. PATENT DOCUMENTS

| | | | | |
|---|---|---|---|---|
| 5,671,715 | A | 9/1997 | Tsuzuki | |
| 5,722,600 | A | 3/1998 | Horiuchi | |
| 6,189,815 | B1 * | 2/2001 | Potschin et al. | 239/533.2 |
| 6,499,467 | B1 * | 12/2002 | Morris et al. | 123/467 |
| 6,758,415 | B2 * | 7/2004 | Fischer et al. | 239/533.2 |
| 6,814,302 | B2 | 11/2004 | Stoecklein et al. | |
| 6,986,474 | B2 | 1/2006 | Bloching et al. | |
| 6,997,166 | B2 | 2/2006 | Stringfellow | |
| 7,093,582 | B2 * | 8/2006 | Magel et al. | 123/446 |
| 7,950,593 | B2 * | 5/2011 | Wang et al. | 239/5 |
| 2004/0055562 | A1 * | 3/2004 | Stewart et al. | 123/299 |
| 2004/0195348 | A1 * | 10/2004 | Lewis et al. | 239/88 |
| 2005/0257777 | A1 * | 11/2005 | Ishizuka et al. | 123/480 |
| 2006/0005815 | A1 * | 1/2006 | Magel et al. | 123/446 |
| 2006/0054149 | A1 * | 3/2006 | Uchiyama | 123/676 |
| 2006/0086818 | A1 | 4/2006 | Boecking | |
| 2006/0151636 | A1 | 7/2006 | Harcombe et al. | |
| 2006/0157582 | A1 * | 7/2006 | Tojo et al. | 239/96 |
| 2007/0215717 | A1 * | 9/2007 | Cooke | 239/102.2 |
| 2007/0277784 | A1 * | 12/2007 | Gibson et al. | 123/446 |
| 2008/0169366 | A1 * | 7/2008 | Lewis et al. | 239/584 |
| 2009/0126689 | A1 * | 5/2009 | Gibson | 123/446 |
| 2009/0165749 | A1 * | 7/2009 | Ibrahim et al. | 123/472 |
| 2009/0184185 | A1 * | 7/2009 | Lewis et al. | 239/585.5 |
| 2009/0260599 | A1 * | 10/2009 | Venkataraghavan et al. | 123/498 |
| 2009/0314860 | A1 * | 12/2009 | Wang et al. | 239/585.1 |
| 2011/0168813 | A1 * | 7/2011 | Bunni et al. | 239/585.4 |

FOREIGN PATENT DOCUMENTS

| | | |
|---|---|---|
| DE | 4406901 | 3/1998 |

* cited by examiner

*Primary Examiner* — John T. Kwon
*Assistant Examiner* — Johnny Hoang
(74) *Attorney, Agent, or Firm* — Carl E. Meyers; Liell & McNeil

(57) ABSTRACT

A common rail single fluid injection system including fuel injectors with the ability to produce multiple injection rate shapes. This is accomplished by including auxiliary filling orifices which selectively provide pressurized fluid to the check needle control chamber during injection events. In so doing, the speed and movement of the check needle is manipulated and differing injection rates may be achieved.

21 Claims, 4 Drawing Sheets

FLUID INJECTOR WITH AUXILIARY FILLING ORIFICE

TECHNICAL FIELD

The present disclosure relates generally to a single fluid fuel injection system, and more particularly to fuel injection systems with an auxiliary filling orifice.

BACKGROUND

Engines, including diesel engines, gasoline engines, natural gas engines, and other engines known in the art, exhaust a complex mixture of combustion related constituents. The constituents may be gaseous and solid material, which include nitrous oxides (NOx) and particulate matter. Due to increased attention on the environment, exhaust emission standards have become more stringent and the amount of NOx and particulate matter emitted from an engine may be regulated depending on the type of engine, size of engine, and/or class of engine.

Engineers have come to recognize that undesirable engine emissions, such as NOx, particulate matter, and unburnt hydrocarbons, can be reduced across an engine's operating range with fuel injection systems with maximum flexibility in controlling injection timing, flow rate, injection quantity, injection rate shapes, end of injection characteristics and other factors known in the art. However, it has also been observed that an injection strategy at one engine operating condition may decrease emissions at that particular operating condition, but actually produce an excessive amount of undesirable emissions at a different operating condition. Thus, for a fuel injection system to effectively reduce emissions across an engine's operating range, it must have the ability to produce several different rate shapes, have the ability to produce multiple injections, and produce injection timings and quantities with relatively high accuracy. Providing a fuel injection system that can perform well with regard to all of these different parameters over an entire engine's operating range has proven to be elusive.

In order to reduce hydrocarbon emissions, one strategy has been to seek an abrupt end to each injection event. This strategy flows from the wisdom that reducing poorly atomized fuel spray into the combustion chamber toward the end of an injection event can reduce the production of undesirable hydrocarbon and smoke emissions. In the case of fuel injectors equipped with direct control needle valves, an abrupt end of injection is often accomplished by applying high-pressure fluid to the back side of a direct control needle valve member to quickly move it toward a closed position while fuel pressure within the injection remains relatively high.

In one example common rail fuel injector disclosed in U.S. Pat. No. 6,814,302 to Stoecklein et al, a needle control chamber has one outlet and one inlet. At the end of injection the inlet fills the needle control chamber. A bypass conduit, which feeds first into a valve chamber and then into the outlet, may provide additional fuel flow to the needle control chamber. The use of a bypass conduit that feeds into the valve chamber and then the needle control chamber outlet has a drawback of inevitably affecting the start of injection. Moreover, the valve and valve chamber required to facilitate the bypass conduit add cost and variability to the operation of the injector.

The disclosed fuel injector with auxiliary filling orifice is directed to overcoming one or more of the problems set forth above.

SUMMARY OF THE DISCLOSURE

In one aspect, a fluid injector including an injector body defining a high pressure inlet, a fuel supply passage, a low pressure drain, and at least one nozzle outlet. Also included is a check needle movable within the fluid injector between a first position at which the check needle blocks the at least one nozzle outlet and a second position at which the check needle at least partially opens the at least one nozzle outlet, the check needle including at least one opening hydraulic surface exposed to a fluid pressure of the fuel supply passage and at least one closing hydraulic surface exposed to a fluid pressure of a check needle control chamber, wherein said check needle control chamber is in selective fluid communication with the low pressure drain via a first orifice, and said check control chamber is in fluid communication with the nozzle supply passage via a second orifice, and said check needle control chamber is in selective fluid communication with the nozzle supply passage via a third orifice. The fluid injector also includes a control valve assembly having a valve member configured to selectively allow fluid communication via the first orifice between the low pressure drain and check control chamber.

In another aspect, an internal combustion engine including an engine housing defining a plurality of engine cylinders, and including a plurality of pistons each being movable within a corresponding one of the engine cylinders. Also included is a fuel system having a plurality of fuel injectors associated one with each of the plurality of engine cylinders, each of the fuel injectors including an injector body defining a high pressure inlet, a fuel supply passage, a low pressure drain, and at least one nozzle outlet. Also included is a check needle movable within the fluid injector between a first position at which the check needle blocks the at least one nozzle outlet and a second position at which the check needle at least partially opens the at least one nozzle outlet, the check needle including at least one opening hydraulic surface exposed to a fluid pressure of the fuel supply passage and at least one closing hydraulic surface exposed to a fluid pressure of a check needle control chamber, wherein said check needle control chamber is in selective fluid communication with the low pressure drain via a first orifice, and said check control chamber is in fluid communication with the nozzle supply passage via a second orifice, and said check needle control chamber is in selective fluid communication with the nozzle supply passage via a third orifice. The fluid injector also includes a control valve assembly having a valve member configured to selectively allow fluid communication via the first orifice between the low pressure drain and check control chamber.

In yet another aspect, a method of operating a fuel injector having a check needle, including the steps of supplying high pressure fuel to a nozzle chamber via a fuel supply passage. The method further includes the step of supplying high pressure fuel to a check needle control chamber via the fuel supply line and a z-orifice. Also included is a step of selectively supplying high pressure fuel to the check needle control chamber via the fuel supply line and an f-orifice. The method further includes a step of moving the check needle from its said first position to its said second position, wherein the check needle prevents fuel injection at the first position, and allows fuel injection at the second position; said moving step is accomplished by allowing fluid communication between the check needle control chamber and a low pressure drain via an a-orifice. The method also includes the step of moving the check needle from its second position to its first position by blocking fluid communication between the check needle control chamber and the low pressure drain via the a-orifice.

DETAILED DESCRIPTION

Figure 1:
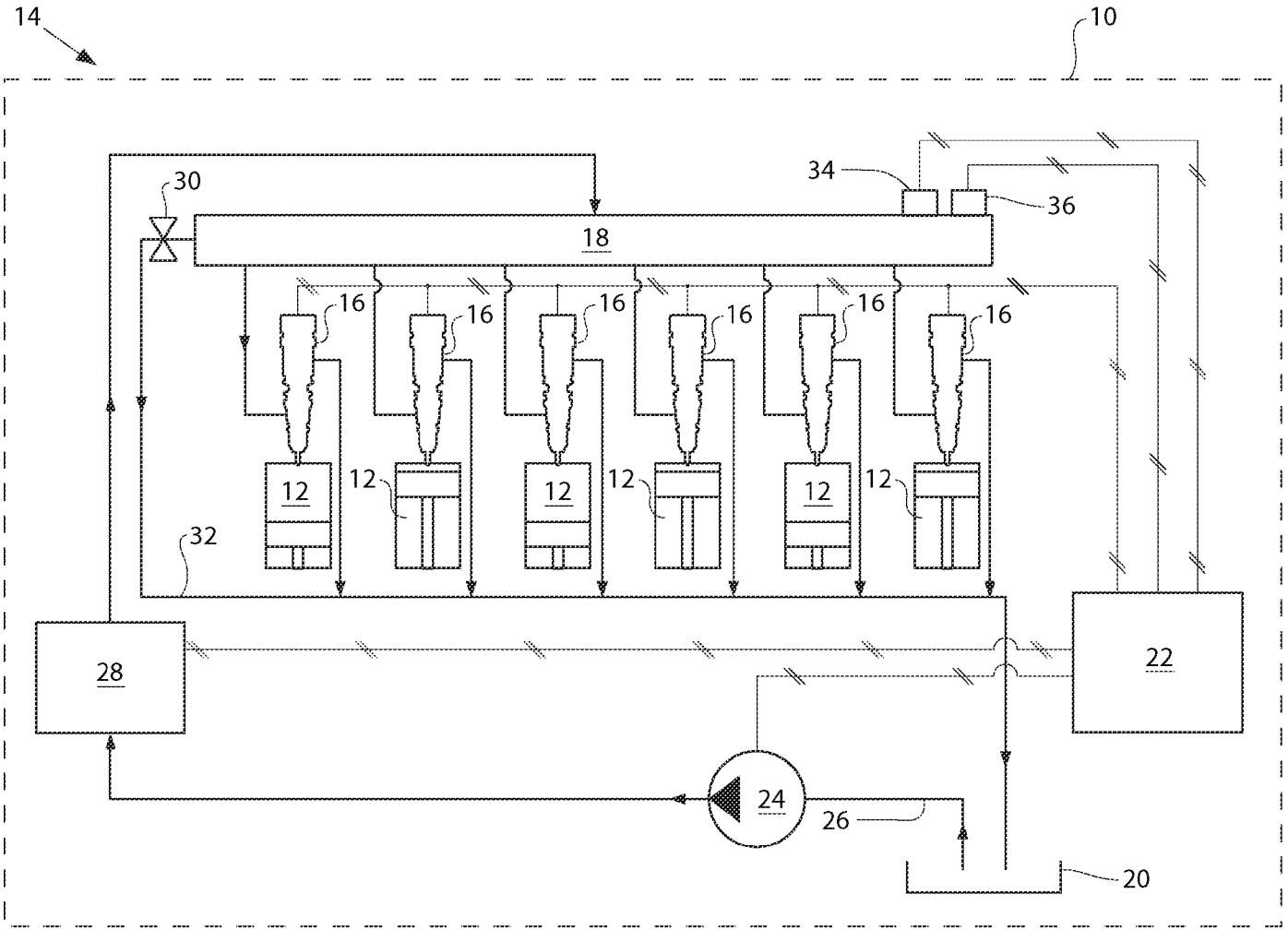
FIG. 1 is a diagrammatic schematic of a fuel system using a common rail fuel injector.

Referring to FIG. 1, an example diesel engine 10 includes six cylinders 12 and a common rail fuel injection system 14. The system includes an individual fuel injector 16 for each engine cylinder 12, a single common rail 18, and a fuel tank 20. Those skilled in the art will appreciate that in other applications there may be two or more separate common rails, such as a separate rail for each side of a V8 engine. An electronic control module 22 controls the operation of fuel injection system 14. The electronic control module 22 preferably utilizes advanced strategies to improve accuracy and consistency among the fuel injectors 16 as well as pressure control in common rail 18. For instance, the electronic control module 22 might employ electronic trimming strategies individualized to each fuel injector 16 to perform more consistently. Consistent performance is desirable in the presence of the inevitable performance variability responses due to such causes as realistic machining tolerances associated with the various components that make up the fuel injectors 16. In another strategy, the electronic control module 22 might employ a model based rail pressure control issue into one of open loop flow control coupled with closed loop error and pressure control.

When fuel injection system 14 is in operation, a transfer pump 24 draws low-pressure fuel through fuel supply line 26 and provides it to high-pressure pump 28. High-pressure pump 28 then pressurizes the fuel to desired fuel injection pressure levels and delivers the fuel to the common rail 18. The pressure in common rail 18 is controlled in part by safety valve 30, which spills fuel to the fuel return line 32 if the pressure in the common rail 18 is above a desired pressure. The fuel return line 32 returns fuel to the fuel tank 20.

Fuel injector 16 draws fuel from common rail 18 and injects it into a combustion cylinder 12 of the engine 10. Fuel not injected by fuel injector 16 is spilled to fuel return line 32. Electronic Control Module (ECM) 22 provides general control for the system. ECM 22 receives various input signals, such as from pressure sensor 34 and a temperature sensor 36 connected to common rail 18, to determine operational conditions. ECM 22 then sends out various control signals to various components including the transfer pump 24, high-pressure pump 28, and fuel injector 16.

Figure 2:
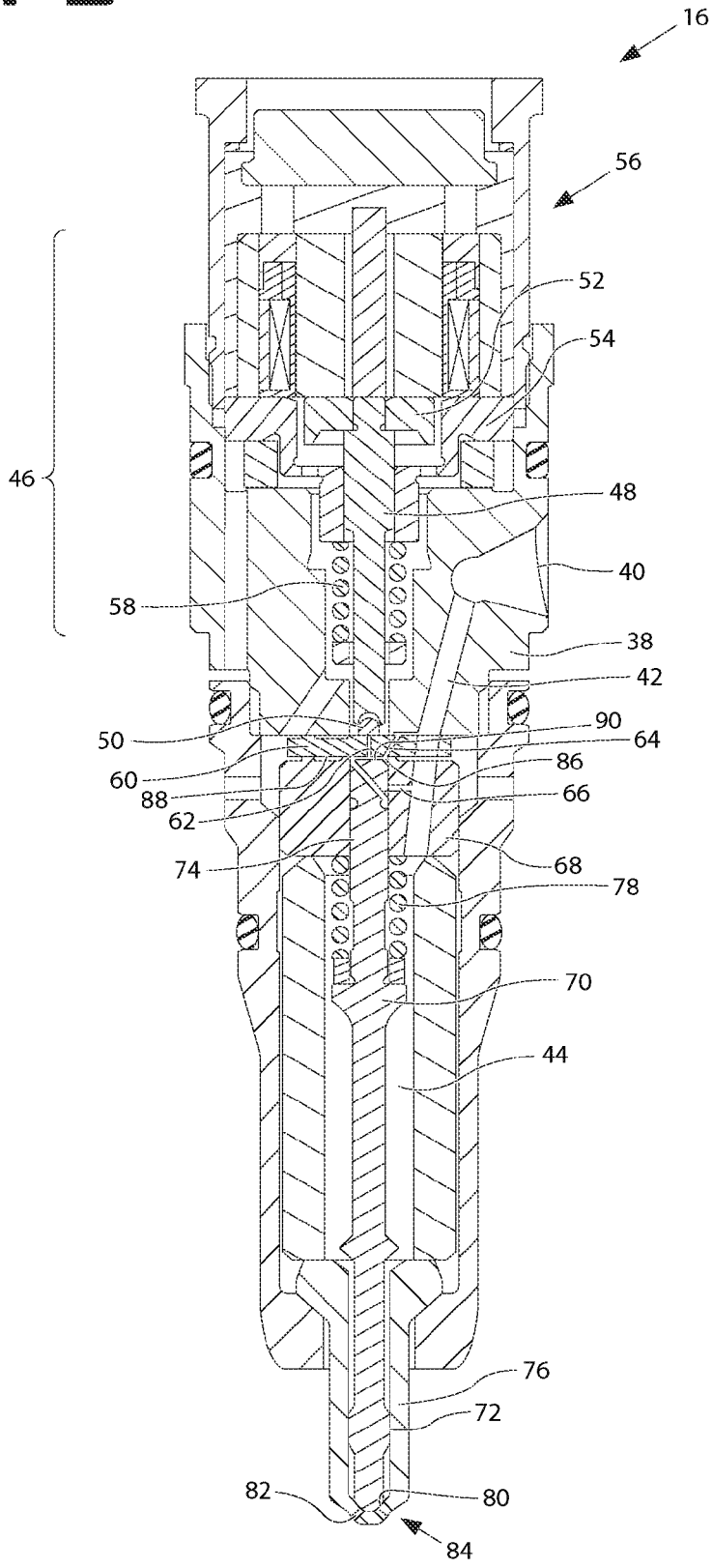
FIG. 2 is a cross section of an exemplary common rail fuel injector utilizing auxiliary filling orifices.

Referring to FIG. 2, the internal structure and fluid circuitry of each fuel injector 16 is illustrated. In particular, an injector body 38 defines a high-pressure fuel supply inlet 40 and a fuel supply passage 42, which are interconnected. Fuel supply passage 42 is in fluid communication with nozzle chamber 44. A control valve assembly 46 is partially disposed within injector body 38. The operation of the fuel injector 16 is controlled, at least partially, by control valve assembly 46. Control valve assembly 46 may include a rod member 48 that controls a valve member 50. The valve member 50 disclosed in FIG. 2 is a ball valve having a flat. However, those skilled in the art will recognized that any myriad of shapes/geometries of valve members may be utilized without departing from the scope of this disclosure. In the embodiment shown, rod member 48 is coupled to an armature 52, which is disposed within an armature guide member 54. Control valve assembly 46 also includes an electrical actuator 56. When electrical actuator 56 is de-energized, a biasing spring 58 biases armature 52, rod member 48 and valve member 50 downward. In this de-energized state, valve member 50 rests atop an orifice plate 60 and seals a first orifice 62, which is defined by the orifice plate 60. This first orifice 62 is also known as the a-orifice. As will be discussed, below, orifice plate 60 may also include a second orifice (z-orifice) 64 and a third orifice (f-orifice) 66. However, in the embodiment shown in FIG. 2, the orifice plate only has a first orifice 62 and second orifice 64. The third orifice is found within an upper check guide 68 of check needle 70. When the electrical actuator 56 is energized, an electromagnetic field is generated. The electromagnetic field causes armature 52 and rod member 48 to lift by overcoming the downward force applied by biasing spring 58. When this happens, valve member 50 is no longer in sealing contact with first orifice 62. It will be appreciated by those skilled in the art that control valve assembly 46 could have many alternate embodiments without deviating from the scope and spirit of this disclosure. These alternate embodiments may include piezo actuation, a needle valve and other armature, spring, control rod and valve member configurations.

Check needle 70 is disposed within nozzle chamber 44. Check needle 70 may have a first end 72 and a second end 74. The first end 72 may be disposed within a lower check guide 76 and the second end 74 may be disposed within the upper check guide 68. A biasing spring 78, which is also disposed within the nozzle chamber 44, biases check member downward in a first position. In this first position, first end 72 of check needle 70 rests on seat 80 and blocks at least one tip orifice 82 disposed within injector tip 84. Check needle 70 is also movable to a second position wherein the first end 72 is at least partially out of contact with seat 80 and the at least one tip orifice 82 is partially unblocked.

Figure 3:
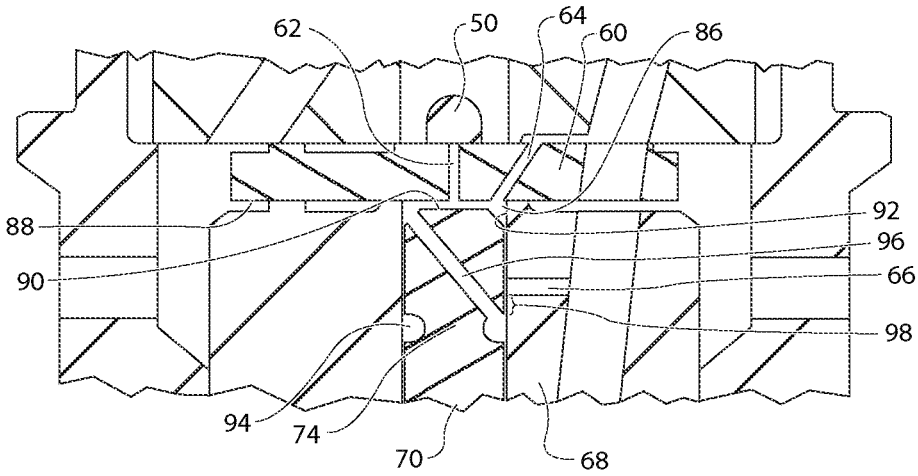
FIG. 3 is a detail of a first embodiment of the check needle and auxiliary filling orifice.

Referring now to FIG. 3, a detail (not to scale) of a first embodiment is shown. A check needle control chamber 86 is defined by a lower surface 88 of orifice plate 60, a distal surface 90 of the second end of check needle 70 and a portion 92 an interior surface of the upper check guide 68. First orifice 62, which may also be called an a-orifice, is in direct fluid communication with check needle control chamber 86. When injector 16 is not injecting fluid, valve member 50 rests atop orifice plate 60 and blocks first orifice 62. As will be explained in greater detail below, during injection, valve member 50 is at least partially out of contact with orifice plate 60 and fluid from check needle control chamber 86 is allowed to drain out of the first orifice 62 and ultimately out of injector 16.

In the embodiment shown in FIG. 3, orifice plate 60 also has a second orifice 64, which may also be called a z-orifice. Second orifice 64 is in direct fluid communication with check needle control chamber 86. Additionally, second orifice 64 is in fluid communication with high-pressure fuel supply passage 42.

An auxiliary, or third orifice 66 is in the upper check guide 68. The third orifice 66, which may also be called an f-orifice, is also in fluid communication with high-pressure fuel supply passage 42 in parallel with the second orifice 64. The third orifice 66 may selectively be in fluid communication with check needle control chamber 86 via a check groove 94 and a check orifice 96. When check needle 70 is in its downward first position, third orifice 66 is out of fluid communication with check needle control chamber 86. In this position, third orifice 66 is blocked by a portion of check needle 70 known as a groove offset 98. When check needle 70 is in a second position, the third orifice 66 is no longer blocked by groove offset 98. In this position, third orifice 66 is in fluid communication with check needle control chamber 86.

The operation of injector 16 will now be explained. The opening and closing of check needle 70 is controlled in part by the presence of high-pressure fuel in fuel supply passage 42. When an injection event is not desired, the electrical actuator 56 of control valve assembly 46 is not energized. High-pressure fuel enters fuel injector 16 through high-pressure fuel supply inlet 40. High-pressure fuel is supplied to nozzle chamber 44 via the high-pressure fuel supply passage 42. High pressure fuel is also supplied to the check needle control chamber 86 via high pressure fuel supply passage 42 and the second orifice 64. The high pressure fuel within check needle control chamber 86 is prevented from escaping through the first orifice 62 by the valve member 50, which is blocking the same. The high-pressure fuel within the check needle control chamber 86 provides a hydraulic load on the distal surface 90 of check needle 70. This hydraulic load coupled with the downward force of biasing spring 78, holds check needle 70 in its first position wherein it rests on seat 80 and blocks the at least one tip orifice 82.

The high-pressure fuel that is provided to nozzle chamber 44 seeks to unseat check needle 70 by applying hydraulic pressure to various surfaces to the check needle 70. These forces seek to lift check needle 70 off of its seat 80. However, when the electrical actuator 56 control valve assembly 46 is deenergized, check needle 70 remains seated because the hydraulic forces applied to the check are countered by hydraulic load applied in the check needle control chamber 86 and the downward force of biasing spring 78.

When injection is desired, the electrical actuator 56 of control valve assembly 46 is energized. The electrical actuator 56 thus creates an electromagnetic field causing armature 52 and rod member 48 to overcome the force of biasing spring 58 and lift. When rod member 48 lifts, the downward force that was holding valve member 50 in place is removed. Thus, valve member 50 also lifts and the high pressure fuel within check needle control chamber 86 is allowed to drain out of the first orifice 62. This fuel ultimately drains out of the injector 16.

When the high pressure fuel drains out of the check needle control chamber 86 through the first orifice 62, the hydraulic load that was on top of the distal surface 90 of check needle 70 decays. At the same time, pressurized fuel is still being provided to nozzle chamber 44 via high pressure fuel supply passage 42. Because of the decay in the hydraulic load in the check needle control chamber 86, there is a pressure imbalance between the nozzle chamber 44 and the check needle control chamber. The higher pressure in the nozzle chamber 44 now applies hydraulic forces to the various surfaces of the check needle 70 causing it to lift off of seat 80. As the check needle 70 is unseated, pressurized fuel is injected into an engine cylinder 12 through the at least one tip orifice 82.

As the check needle 70 moves from its first position to its second position wherein it is out of contact with seat 80, it eventually travels a distance equal to that of the groove offset 98. When the check needle 70 moves a distance equal to that of the groove offset 98, the third orifice 66, which was heretofore blocked, comes into fluid communication with the check needle control chamber 86. In the embodiment shown in FIG. 3, the groove offset 98 is sized such that it is approximately 60% to 80% of the total distance traveled by check needle 70 during an injection event. Preferably, the groove offset 98 is sized such that it is 65% to 75% of the total distance traveled by a check needle during an injection event. Because the third orifice 66 is blocked from fluid communication with check needle control chamber 86 while check needle 70 travels a distance equal to the groove offset 98, the high pressure fuel, which comes through the third orifice 66 does not substantially interfere with the opening of check needle 70. (See FIG. 5.).

When it is desirable to stop injection, electrical actuator 56 is deenergized. As the electromagnetic field generated by electrical actuator 56 dissipates, the force of biasing spring 58 acts on rod member 48 and armature 52. As rod member 48 and biasing spring 58 apply a downward force on valve member 50, it in turn returns to its position on orifice plate 60, wherein it blocks first orifice 62. When the first orifice 62 is blocked, check needle control chamber 86 begins to fill with high-pressure fuel. Initially, both the second orifice 64 and third orifice 66 provide high-pressure fuel to fill the check needle control chamber 86. However, as the high pressure fuel within check needle control chamber 86 begins to apply a hydraulic load on the distal surface 90 of check needle 70, check needle 70 begins to move downward toward seat 80. As check needle 70 moves downward, third orifice 66 will subsequently become blocked by groove offset 98. When this happens, third orifice 66 is no longer in fluid communication with check needle control chamber 86. The second orifice 64 then continues to fill the check needle control chamber 86 until the hydraulic load caused by the high pressure fluid in the check needle control chamber 86 and the downward force of biasing spring 78 cause check needle 70 to return to its first position. When check needle 70 returns to its seat 80, the tip orifice 82 is blocked and injection ends.

Figure 5:
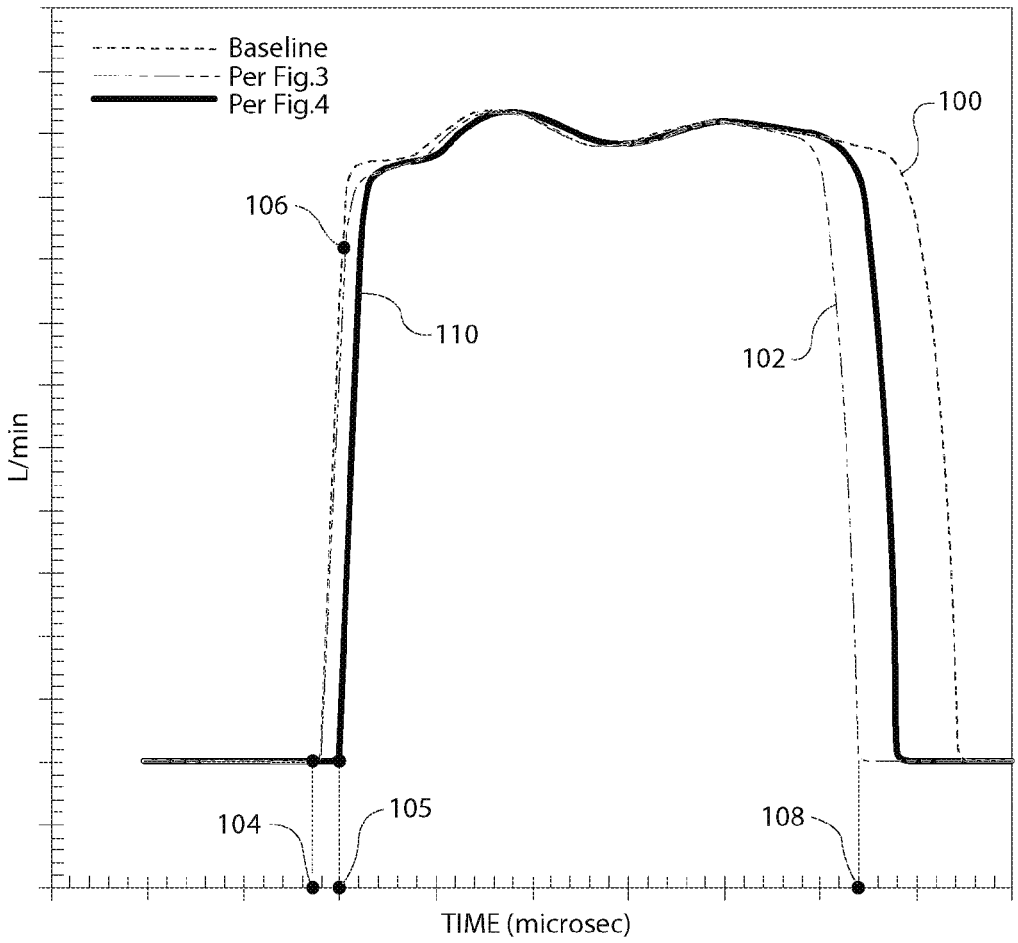
FIG. 5 is a comparison graph showing fuel delivery rates of an injector using and not using the disclosed embodiments.

Referring now to FIG. 5, which depicts three curves showing fuel injector fluid delivery rate versus time. Curve 100 is an exemplary delivery rate of an injector that does not employ the techniques disclosed in the present application. Curve 102 is an exemplary delivery rate of an injector that does employ the techniques disclosed in the present application. Generally speaking, curves 100 and 102 are virtually identical from point 104, which is the start of injection, until point 106. On curve 102, point 106 represents the point where check needle 70 moves beyond the groove offset 98. At point 106, the delivery rates begin to differ. On curve 102, the delivery rate begins to slow down. However, engineers have learned that this slowing down is of negligible effect on start of injection events. The reason that this slowing has a negligible effect is because by the time point 106 occurs, most of the fuel that will be delivered to the an engine cylinder has already been delivered. In other words, because of the placing of the third orifice 66 within the upper check guide 68 and the groove offset 98, the effect of the third orifice 66 in the embodiment of FIG. 3 is essentially masked until the end of injection where it assists in providing a faster closing of check needle 70.

Point 108 represents the time at which the electrical actuator of a control valve assembly is deenergized. This point represents the beginning of the end of injection. As can be clearly seen, curve 102 moves to a zero fluid delivery rate significantly faster than curve 100. The reason for this is because on curve 102, the second and third orifices together (Curve 102) fill the check needle control chamber faster than the second orifice can on its own (Curve 100). Improved speed in filling the check needle control chamber leads directly to a faster closing of check needle and end of injection.

Figure 4:
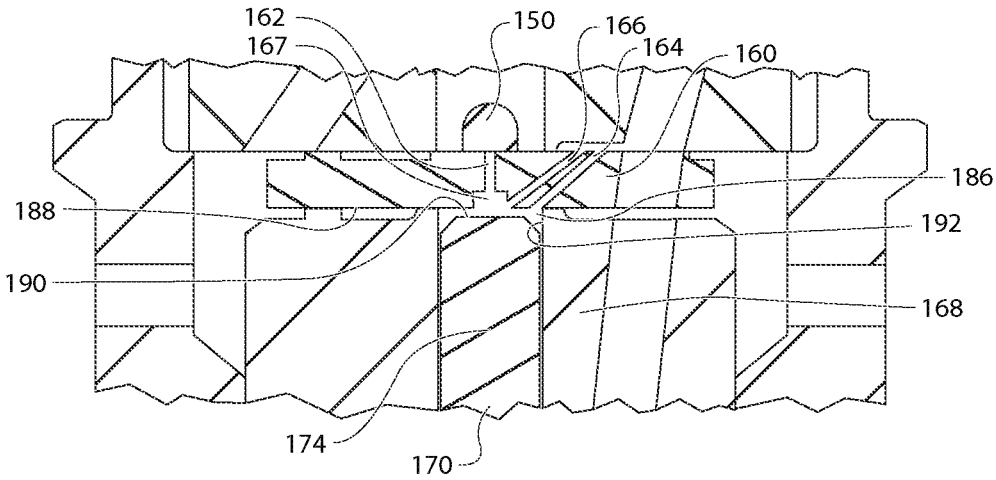
FIG. 4 is a detail of an alternate embodiment of the check needle and auxiliary filling orifice.

Referring now to FIG. 4, a detail (not to scale) of a second embodiment is shown. A check needle control chamber 186 is defined, at least partially, by a lower surface 188 of orifice plate 160, a distal surface 190 of a second end 174 of check needle 170 and a portion 192 of an interior surface of the upper check guide 168. First orifice 162, which may also be called an a-orifice, is in direct fluid communication with check needle control chamber 186. In the embodiment shown, in FIG. 4, the orifice plate 160 includes a counter bore 167, which may further facilitate fluid communication between the first orifice 162 and the check needle control chamber 186. When fuel injector 16 is not injecting fluid, valve member 150 rests atop orifice plate 160 and blocks first orifice 162. During injection, valve member 150 is at least partially out of contact with orifice plate 160 and fluid from check needle control chamber 186 is allowed to drain through counter bore 167 and the first orifice 162 and ultimately out of the fuel injector 16.

In the embodiment shown in FIG. 4, orifice plate 160 also has a second orifice 164, which may also be called a z-orifice. Second orifice 164 is in direct fluid communication with check needle control chamber 186. Additionally, second orifice 164 is in fluid communication with high-pressure fuel supply passage 42 in parallel with second orifice 164. An auxiliary, or third orifice 166 is also in the orifice plate 160. The third orifice 166, which may also be called an f-orifice, is also in fluid communication with high-pressure fuel supply passage 42. The third orifice 166 is also in direct fluid communication with check needle control chamber 186 via counter bore 167.

In operation, the embodiment shown in FIG. 4 operates in much the same way as that of the embodiment in FIG. 3. The differences relate to the manner in which the third orifice 166 comes into play at the very beginning of an injection event. The third orifice 166 in FIG. 4 is always in direct fluid communication with the check needle control chamber 186 via counter bore 167. Thus, at the very beginning of an injection event, the unseating of check needle 170 is manipulable. The speed in which check needle 170 unseats will be slowed depending on the sizing of the counter bore 167, the second orifice 164 and the third orifice 166. This slowing is caused because high-pressure fluid supplied to the check needle control chamber 186 from both the second orifice 164 and third orifice 166 must drain out of the first orifice 162. Alternatively, in the embodiment shown in FIG. 3, the third orifice 66 is not in fluid communication with the check needle control chamber 86 until after the check needle 70 has moved a distance equal to the groove offset 98. Thus, the effect of the sizing of the second orifice 64 and third orifice 66 is minimized as compared to that of the embodiment in FIG. 4.

At the end of injection, the embodiments of FIG. 4 and FIG. 3 operate in nearly identical manners. When the valve member 150 is returned to its position atop the orifice plate 160 and the first orifice 162 is blocked, high pressure fluid from fuel supply passage 42 is delivered to the check needle control chamber 186 via both the second orifice 164 and the third orifice 166. The high pressure fluid provided to the check needle control chamber 186 via the second orifice 164 and third orifice 166 creates a hydraulic load on the distal surface 190 of the second end 174 of check needle 170. This hydraulic load provides a force that assists in returning the check needle 170 to its seat 80. As with the embodiment in FIG. 3, the embodiment of FIG. 4 has a faster closing of check needle 170 because the pressure within the check needle control chamber 186 builds faster when two orifices (164, 166) supply high pressure fluid as opposed to just one orifice.

Curve 110 on FIG. 5 shows the fuel delivery rate of an exemplary injector using the auxiliary orifice of embodiment of FIG. 4. As can be seen, there is a slight delay in the start of injection because of the presence of the additional orifice 166. Thus, while a start of current may begin at time point 104, the actual start of injection may not begin until time point 105. At point 105, curve 110 begins to deliver fuel at a rate slower than that of curves 100 and 102. One reason for this slower delivery is because in addition to the second orifice 164, a third orifice 166 is providing high-pressure fuel to the check needle control chamber 186. Another reason for the slower delivery is because in the embodiment depicted in FIG. 4, the third orifice 166 is always in fluid communication with the check needle control chamber 186 via counter bore 167. In other words, there is no groove offset where the third orifice 166 is blocked for a period of time after the start of injection.

Although not shown in FIG. 5, in some embodiments, the injector of FIG. 4 may not deliver as much fuel as that of injectors that do not have an additional orifice such as 166. One reason for this may be because the continuous fluid delivery from the third orifice 166 limits the travel distance of check needle 170. Thus, curve 110 would not have an apex as high as that of curves 100 and 102. Notwithstanding, those skilled in the art would readily understand how to adjust the sizes of the first orifice 162, second orifice 164, third orifice 166, and the counter bore 167, to allow the embodiment shown in FIG. 4 to deliver a maximum amount of fuel approximately equal to that delivered by FIG. 3. This approximately equal amount of fuel delivery is shown in FIG. 5.

At end of injection time point 108, curve 110 functions very similarly to that of curve 102. In other words, after the drain or first orifice 162 is blocked, the high pressure fluid delivered to the check needle control chamber 186 from second orifice 164 and third orifice 166, acts to quickly close check needle 170. Here too, there may be a slight delay in end of injection because of the presence of the third orifice 166. However, even with this slight delay, the end of injection is still faster than injectors that do not use the techniques employed in this application.

Industrial Applicability

The present disclosure finds a preferred application in common rail fuel injection systems. In addition the present disclosure finds preferred application in single fluid, namely fuel injection, systems. Although the disclosure is illustrated in the context of a compression ignition engine, the disclosure could find application in other engine applications, including but not limited to spark ignited engines.

The embodiments of FIGS. 3 and 4 may provide multiple delivery rates for fuel injectors. The selection of which embodiment is utilized may depend on anticipated engine operating conditions such as engine speed and load. Depending on the desired start of injection characteristics, engineers employing the designs of the disclosed fuel injectors may produce a square or ramp shaped fuel delivery curve (See FIG. 5). However, regardless of which embodiment is selected, the end of injection profile is consistently faster. Specifically, the end of injection profile is faster in injectors that employ the methods and techniques outlined in this application, as opposed to those that do not. The presence of a third orifice (66, 166) supplying high pressure fluid to the check needle control chamber (86, 186) leads to a faster build up of hydraulic load on the distal surface (90, 190) of the second end (74, 174) of the check needle (70, 170). Thus, the check needle (70, 170) returns to its seat 80 faster.

The above description is intended for illustrative purposes only and is not intended to limit the scope of the present disclosure in any way. Thus, those skilled in the art will appreciate the various modifications that can be made to the illustrated embodiments without departing from the spirit and scope of the disclosure, which is defined in the terms of the claims set forth below.

What is claimed is:

1. A fluid injector comprising:

an injector body defining a high pressure inlet, a fuel supply passage, a low pressure drain, and at least one tip orifice;

a check needle movable within the fluid injector between a first position at which the check needle blocks the at least one nozzle outlet and a second position at which the check needle at least partially opens the at least one nozzle outlet, the check needle including at least one opening hydraulic surface exposed to a fluid pressure of the fuel supply passage and at least one closing hydraulic surface exposed to a fluid pressure of a check needle control chamber, wherein said check needle control chamber is in selective fluid communication with the low pressure drain via a first orifice, and said check needle control chamber is in fluid communication with the fuel supply passage via a second orifice, and said check needle control chamber is in selective fluid communication with the fuel supply passage via a third orifice, which is in parallel with the second orifice; and a control valve assembly having a valve member movable between a first position at which the low pressure drain is blocked to the check needle control chamber, and a second position at which the check needle control chamber is in fluid communication with the low pressure drain.

2. The fluid injector of claim 1, wherein the check needle blocks fluid communication between the fuel supply passage and the check needle control chamber via the third orifice when the check needle is in the first position and allows fluid communication when the check needle is in the second position.

3. The fluid injector of claim 2, wherein the fluid communication between the fuel supply passage and the check needle control chamber is further established via a groove on the check needle and an orifice through the check needle.

4. The fluid injector of claim 3, wherein the second position is further defined by a predetermined groove offset distance traveled by the check needle.

5. The fluid injector of claim 4, wherein the groove offset distance is equal to 60-80% of a total distance traveled by the check needle between the first position and second position.

6. The fluid injector of claim 5, wherein the groove offset distance is equal to 65-75% of the total distance.

7. The fluid injector of claim 1, wherein the third orifice is positioned such that it is in fluid communication with the check needle control chamber when the check needle is at the first position and the second position.

8. An internal combustion engine comprising:

an engine housing defining a plurality of engine cylinders, and including a plurality of pistons each being movable within a corresponding one of the engine cylinders; and a fuel system including a plurality of fuel injectors associated one with each of the plurality of engine cylinders, each of the fuel injectors including an injector body defining a high pressure inlet, a fuel supply passage, a low pressure drain, and at least one tip orifice;

a check needle movable within the fluid injector between a first position at which the check needle blocks the at least one nozzle outlet and a second position at which the check needle at least partially opens the at least one nozzle outlet, the check needle including at least one opening hydraulic surface exposed to a fluid pressure of the fuel supply passage and at least one closing hydraulic surface exposed to a fluid pressure of a check needle control chamber, wherein said check needle control chamber is in selective fluid communication with the low pressure drain via a first orifice, and said check needle control chamber is in fluid communication with the fuel supply passage via a second orifice, and said check needle control chamber is in selective fluid communication with the fuel supply passage via a third orifice, which is in parallel with the second orifice; and a control valve assembly having a valve member movable between a first position at which the low pressure drain is blocked to the check needle control chamber, and a second position at which the check needle control chamber is in fluid communication with the low pressure drain.

9. The internal combustion engine of claim 8, wherein the check needle blocks fluid communication between the fuel supply passage and the check needle control chamber via the third orifice when the check needle is in the first position and allows fluid communication when the check needle is in the second position.

10. The internal combustion engine of claim 9, wherein the fluid communication between the fuel supply passage and the check needle control chamber is further established via a groove on the check needle and an orifice through the check needle.

11. The internal combustion engine of claim 10, wherein the second position is further defined by a predetermined groove offset distance traveled by the check needle.

12. The internal combustion engine of claim 11, wherein the groove offset distance is equal to 60-80% of the total distance traveled by the check needle between the first position and the second position.

13. The internal combustion engine of claim 12, wherein the groove offset distance is equal to 65-75% of the total.

14. The internal combustion engine of claim 8, wherein the third orifice is positioned such that it is in fluid communication with the check needle control chamber when the check needle is at the first position and the second position.

15. A method of operating a fuel injector having a check needle, comprising the steps of:

supplying high pressure fuel to a nozzle chamber via a fuel supply passage;

supplying high pressure fuel to a check needle control chamber via the fuel supply passage and a z-orifice;

selectively supplying high pressure fuel to the check needle control chamber via the fuel supply passage and an f-orifice in parallel with the z-orifice, moving the check needle from a first position to a second position, wherein the check needle prevents fuel injection at the first position, and allows fuel injection at the second position; said moving step is accomplished by allowing fluid communication between the check needle control chamber and a low pressure drain via an a-orifice; and moving the check needle from the second position to the first position by blocking fluid communication between the check needle control chamber and the low pressure drain.

16. The method of claim 15, wherein the step of selectively supplying high pressure fuel to the check needle control chamber via the fuel supply passage and the f-orifice is accomplished such that when the check needle is in the first position, fluid communication between the check needle control chamber and the fuel supply passage via the f-orifice is blocked by a portion of the check needle, and when the check needle is in the second position, fluid communication between the check needle control chamber and the fuel supply line via the f-orifice is established by the check needle.

17. The method of claim 16, wherein the step of selectively supplying high pressure fuel to the check needle control chamber via the fuel supply passage and f-orifice is further facilitated by a groove on the check needle and an orifice through the check needle.

18. The method of claim 17, wherein the second position is further defined by a predetermined groove offset distance traveled by the check needle.

19. The method of claim 18, wherein the groove offset distance is equal to approximately 60-80% of the total distance traveled by the check needle during an injection event.

20. The method of claim 19, wherein the groove offset distance is equal to approximately 65-75% of the total distance traveled by the check needle during an injection event.

21. The method of claim 15, wherein the f-orifice is positioned such that it is always in fluid communication with the check needle control chamber.

* * * * *